US005169230A

United States Patent [19]

Palmer

[11] Patent Number: 5,169,230

[45] Date of Patent: Dec. 8, 1992

[54] LAMP FOR PRODUCING LIGHT INTENSITY UNIFORMITY

[75] Inventor: Glade M. Palmer, North Layton, Utah

[73] Assignee: The United States of America as represented by the Secretary of the Air Force, Washington, D.C.

[21] Appl. No.: 721,856

[22] Filed: Jun. 20, 1991

[51] Int. Cl.[5] ..... F21V 7/00

[52] U.S. Cl. ..... 362/350; 362/216; 362/304; 362/310

[58] Field of Search ..... 362/216, 304, 305, 310, 362/343, 347, 350, 303, 267

[56] References Cited

U.S. PATENT DOCUMENTS

| | | | |
|---|---|---|---|
| 1,935,729 | 11/1933 | Rosenbaum | 362/216 |
| 2,415,635 | 2/1947 | Hopkins | 362/350 X |
| 2,538,681 | 1/1951 | Gangbin | 362/216 |
| 4,275,433 | 6/1981 | Caldwell | 362/267 X |
| 4,355,350 | 10/1982 | Mader | 362/347 |
| 4,481,563 | 11/1984 | Snyder et al. | 362/296 |
| 4,518,224 | 5/1985 | Habro | 350/606 |
| 4,646,215 | 2/1987 | Levin et al. | 362/296 |
| 4,733,338 | 3/1988 | Feher et al. | 362/310 |
| 4,855,886 | 8/1989 | Eijkelenboom et al. | 362/350 |

*Primary Examiner*—Stephen F. Husar

*Attorney, Agent, or Firm*—Robert L. Nathans; Donald J. Singer

[57] ABSTRACT

A circular light emitting filament is positioned adjacent an annular light blocking lip extending from a bowl-shaped reflector. A substantially conical reflector portion extends from the cancer of the reflector and has an apex coincident with the lamp projection axis. The result is that all of the light is reflected before being projected from the lamp and good light intensity uniformity is attained at the illuminated scene.

1 Claim, 1 Drawing Sheet

LAMP FOR PRODUCING LIGHT INTENSITY UNIFORMITY

STATEMENT OF GOVERNMENT INTEREST

The invention described herein may be manufactured and used by or for the Government for governmental purposes without the payment of any royalty thereon.

BACKGROUND OF THE INVENTION

The present invention relates to the field of luminaires.

In prior art lamps, a bulb is centrally positioned within a reflector. Since some of the light rays are directly projected outwardly from the bulb without being reflected by the reflector, and other rays are directed outwardly after being reflected by the reflector, non-uniformity of intensity is created across a scene to be illuminated. The reflected light has a lower intensity than the non-reflected light since a portion of the light striking the reflector is converted into heat.

Thus there is a need for a lamp which produces a substantially uniform degree of light intensity across a plane taken through a scene being illuminated in front of the lamp, and which eliminates shadows or dark spots upon the illuminated scene.

BRIEF SUMMARY OF THE INVENTION

The aforesaid need is filled by providing a concave open-ended reflector that is rotationally symmetric about the lamp projection axis and has a centralized conical portion, the reflector having an annular light blocking lip member positioned around outer portions of the reflector together with a thin circular light emitting filament closely adjacent the light blocking member so that substantially all of the light produced by the filament is reflected off of the reflector before being outwardly projected from the lamp.

BRIEF DESCRIPTION OF THE DRAWINGS

Other objects, features and advantages of the invention will become apparent from the reading of the following description taken in conjunction with the drawing in which.

SPECIFIC DESCRIPTION

Figure 2:
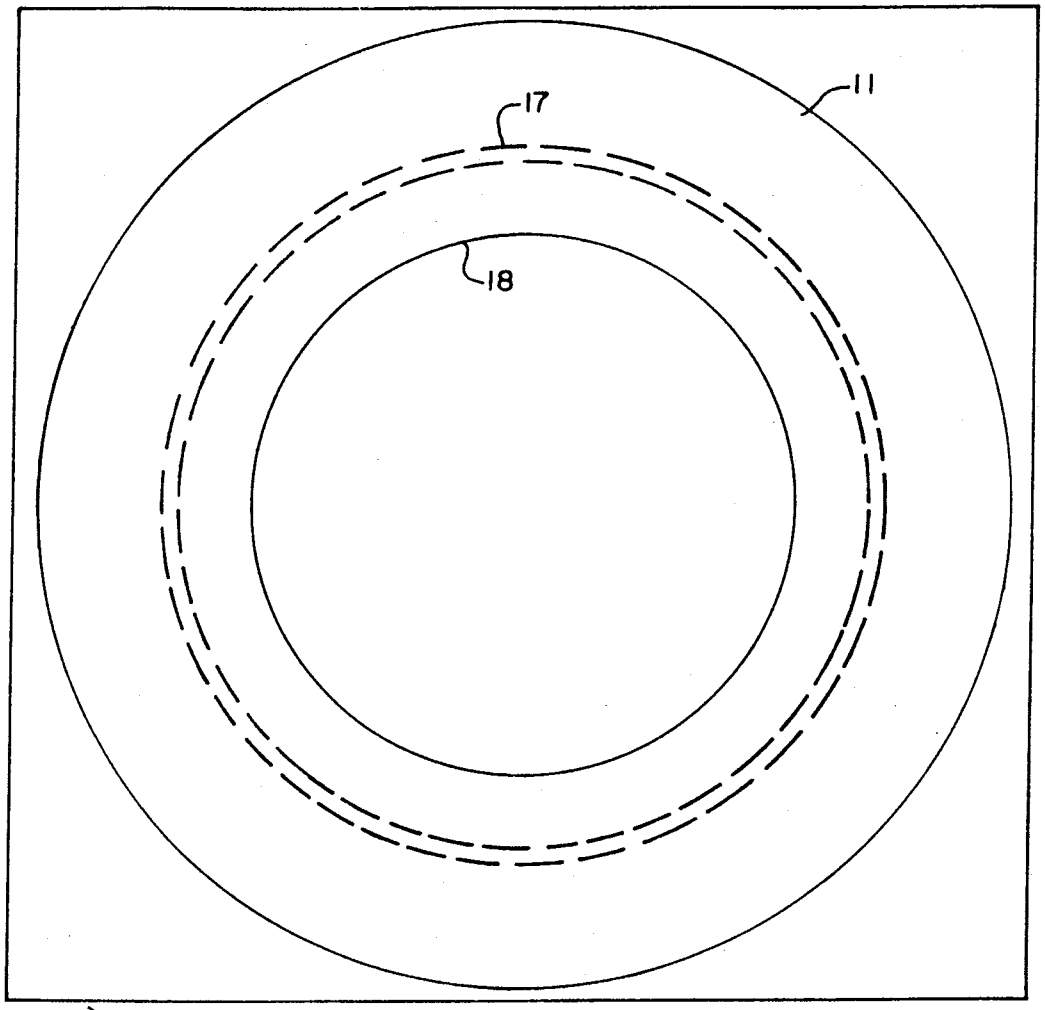
FIG. 2 illustrates a head-on view of the lamp.

Enclosure 1 could have a transparent cover 3 perpendicular to light projection axis 5. Enclosure 1 contains a bowl-shaped concave reflector having an upper portion 11 and an identical lower portion 13, together with a centrally positioned, substantially cone-shaped portion 9 having an apex 7 coincident with axis 5, as shown in FIG. 1.

An annular outwardly light blocking inwardly reflective lip member 15 could be affixed to peripheral portions of the reflector, or could be integral with the reflector, and extends all around the reflector. An incandescent thin circular light emitting filament 17 also extends all around peripheral portions of the reflector and is preferably adjacent the light blocking lip member as shown. Enclosure 1 preferably is a vacuum enclosure, and the filament may be mounted on the reflector by known fastening devices.

The filament 17, the extreme outer edge of the reflector, and the inner edge 18 of the annular light blocking lip 15 are all circular as shown in FIG. 2.

Figure 1:
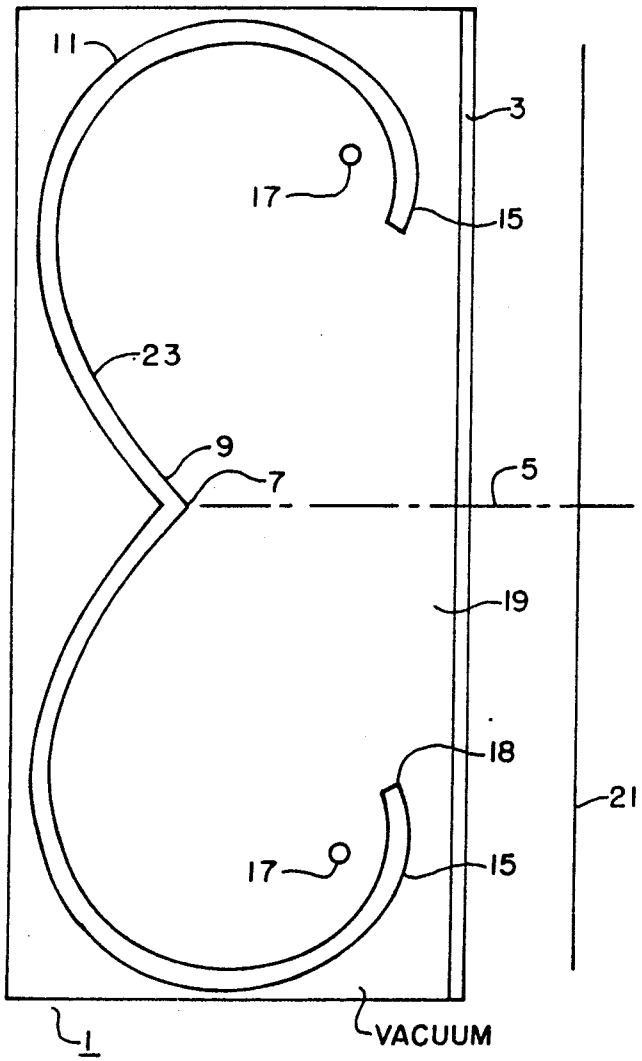
FIG. 1 illustrates a cross-section of the lamp.

The presently preferred actual cross-sectional shape of the reflector shown in FIG. 1 was estimated by experimentation, utilizing about thirty segmented mirrors which consisted of small blocks having light reflecting film adhered thereto. I positioned and tilted the blocks numerous times while I measured light intensity across plane 21 with a photometer. The use of small mirror panels/segments as building blocks to approximately simulate an optical mirror having a continuous curved surface is well known in the art. After a period of trial and error, substantial uniformity of light intensity was produced in front of the lamp on plane 21 with the reflective blocks approximating the reflector shape shown in cross-section in FIG. 1. The intensity variations across the plane shown in FIG. 1, did not vary more than about plus or minus two and one half percent of the average intensity value. The outer diameter of the simulated reflector was about ten inches and the reflector width from reflector bottom portion 23 to the light blocking lip was about four inches.

Thus, my experimental results verified my belief that the rays projected outwardly from the lamp should first be reflected in order to obtain good intensity uniformity. I also found that the substantially cone-shaped central reflector portion 9 provided the best results.

While there has been described what is at present considered to be the preferred embodiments of this invention, it will be obvious to those skilled in the art that various changes and modifications may be made therein without departing from the invention and it is, therefore, intended in the appended claims to cover all such changes and modifications as fall within the true spirit and scope of the invention, including art recognized equivalents.

I claim:

1. A lamp for producing light intensity uniformity across a plane to be illuminated in front of said lamp comprising:

(a) a concave, bowl-shaped, open ended annular reflector that includes (a-1) a centrally positioned outwardly projecting substantially conical reflective portion (9) having an apex (7) coincident with a lamp projection axis (5);

(a-2) and furthermore has cross-sections, taken through a plane rotating about and including said lamp projection axis, having reflective surface curvatures assuming the shape as shown in FIG. 1; and (b) a circular light emitting annular member (17) positioned between facing inside peripheral reflective portions of said concave, bowl-shaped, open ended annular reflector.

* * * * *